US012434125B2

(12) United States Patent
Rusakov et al.

(10) Patent No.: US 12,434,125 B2
(45) Date of Patent: Oct. 7, 2025

(54) LEG GUARDS WITH HINGES

(71) Applicant: EASTON DIAMOND SPORTS, LLC, Thousand Oaks, CA (US)

(72) Inventors: Dmitry Rusakov, Carignan (CA); Kevin Chen, Los Angeles, CA (US); Tazo Osawa, Los Angeles, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

(21) Appl. No.: 18/443,646

(22) Filed: Feb. 16, 2024

(65) Prior Publication Data

US 2025/0262510 A1 Aug. 21, 2025

(51) Int. Cl.
*A63B 71/12* (2006.01)

(52) U.S. Cl.
CPC .. *A63B 71/1225* (2013.01); *A63B 2071/1241* (2013.01); *A63B 2071/125* (2013.01); *A63B 2071/1258* (2013.01); *A63B 2071/1275* (2013.01)

(58) Field of Classification Search
CPC ..... A63B 71/1225; A63B 2071/1241; A63B 2071/125; A63B 2071/1258; A63B 2071/1275
See application file for complete search history.

(56) References Cited

U.S. PATENT DOCUMENTS

| | | | | | |
|---|---|---|---|---|---|
| 909,215 | A * | 1/1909 | Nickerson | A63B 71/1225 | 2/22 |
| 4,692,946 | A * | 9/1987 | Jurga | A63B 71/1225 | 2/22 |
| 4,888,826 | A * | 12/1989 | Parsons, Jr. | A63B 71/1225 | 2/22 |
| 5,452,475 | A * | 9/1995 | Hunt, Jr. | A63B 71/1225 | 2/22 |
| 5,611,080 | A * | 3/1997 | Skottheim | A41D 13/0568 | 2/22 |
| 5,634,211 | A * | 6/1997 | Chen | A63B 71/1225 | 2/24 |
| 6,178,556 | B1 * | 1/2001 | Foreman | A63B 71/08 | 2/22 |
| 6,560,781 | B1 * | 5/2003 | Keene | A63B 71/1225 | 2/22 |
| 7,743,429 | B2 | 6/2010 | Bevier | | |
| 9,149,709 | B1 | 10/2015 | Schuster et al. | | |
| D788,375 | S | 5/2017 | Guidetti | | |

(Continued)

*Primary Examiner* — Khaled Annis
(74) *Attorney, Agent, or Firm* — PERKINS COIE LLP

(57) ABSTRACT

Protective equipment for protecting a portion of a user's body (such as an articulating leg guard for protecting part of a user's leg) may include a knee guard assembly for covering at least a portion of a user's anterior knee region, a thigh guard assembly for covering at least a portion of a user's anterior thigh region, and at least two connection elements positioned to connect the knee guard assembly to the thigh guard assembly. The connection elements may be rotatably attached to the knee guard assembly at a first rotation axis and rotatably attached to the thigh guard assembly at a second rotation axis that is spaced apart from the first rotation axis. The leg guard may further include a floating knee guard assembly for covering at least a portion of a user's leg when a gap forms between the knee guard assembly and the thigh guard assembly.

23 Claims, 9 Drawing Sheets

(56) References Cited

U.S. PATENT DOCUMENTS

| | | | | |
|---|---|---|---|---|
| 10,293,241 | B2 | 5/2019 | Rodrick et al. | |
| 2003/0024029 | A1* | 2/2003 | Fiorini | A41D 13/065 2/22 |
| 2003/0154540 | A1* | 8/2003 | Nishimoto | A63B 71/1225 2/220 |
| 2007/0250977 | A1* | 11/2007 | Brown | A41D 13/0543 2/22 |
| 2008/0178360 | A1* | 7/2008 | Nascimento | A63B 71/1225 2/22 |
| 2013/0007938 | A1* | 1/2013 | LoCicero | A41D 13/06 2/24 |
| 2016/0249692 | A1 | 9/2016 | Guidetti | |
| 2017/0055603 | A1 | 3/2017 | Guidetti et al. | |
| 2018/0326290 | A1* | 11/2018 | Rodrick | A63B 71/1225 |
| 2019/0192954 | A1 | 6/2019 | Runzo et al. | |
| 2021/0379475 | A1* | 12/2021 | Dierkes | A63B 71/1225 |
| 2022/0241673 | A1* | 8/2022 | Buchas, III | A41D 13/0556 |
| 2022/0322762 | A1 | 10/2022 | Wong | |
| 2023/0053749 | A1* | 2/2023 | Long | A41D 13/065 |
| 2023/0128631 | A1* | 4/2023 | Tryner | A63B 71/1225 2/22 |
| 2024/0399237 | A1* | 12/2024 | Miyakoshi | A63B 71/1225 |

* cited by examiner

LEG GUARDS WITH HINGES

BACKGROUND

A baseball or softball catcher transitions between a throwing position and a crouching position many times during a game or practice session. Conventional leg guards for baseball or softball typically have limited range of motion. Conventional leg guards tend to shift on the player's leg when the player moves, which requires the player to readjust the equipment during play.

SUMMARY

Representative embodiments of the present technology include a leg guard, such as an articulating leg guard for a baseball or softball catcher. A representative leg guard may include a knee guard assembly for covering at least a portion of a user's anterior knee region, a thigh guard assembly for covering at least a portion of a user's anterior thigh region, and at least two connection elements positioned to connect the knee guard assembly to the thigh guard assembly. The connection elements may be rotatably attached to the knee guard assembly at a first rotation axis and rotatably attached to the thigh guard assembly at a second rotation axis that is spaced apart from the first rotation axis. The leg guard may further include a floating knee guard assembly for covering at least a portion of a user's anterior knee region when a gap forms between the knee guard assembly and the thigh guard assembly.

Embodiments of the present technology provide a hinge design that allows cooperating leg-guard components to cover the corresponding portions of the user's leg throughout the user's range of motion.

Other features and advantages will appear hereinafter. The features described herein can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to protective gear with hinges, such as leg guards with hinges, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to protective equipment such as leg guards, may not be shown or described in detail to avoid unnecessarily obscuring the relevant description of the various embodiments. Accordingly, embodiments of the present technology may include additional elements or exclude some of the elements described below with reference to FIGS. 1A through 4C, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components. Numerical adjectives including "first" and "second," as used in the present disclosure, do not convey hierarchy or specific features or functions. Rather, such numerical adjectives are intended to aid the reader in distinguishing between elements having similar nomenclature but that may differ in position, orientation, or structure. Accordingly, such numerical adjectives may be used differently in the claims.

Specific details of several embodiments of the present technology are described herein with reference to leg guards for baseball or softball. Embodiments of the present technology can be used in other sports or in other industries or activities, or for guards for other anatomy, such as arm guards.

Figure 1A:
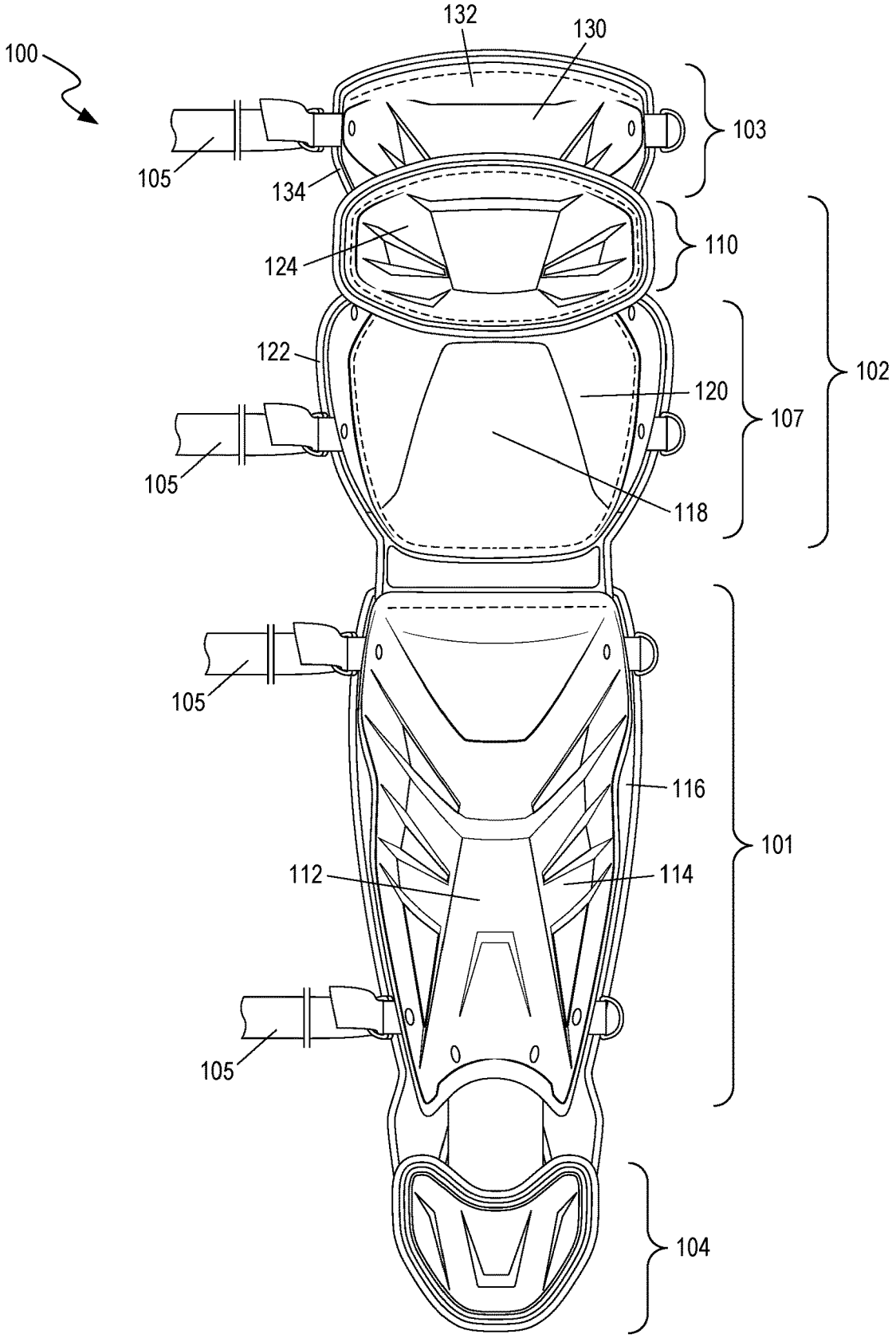
FIG. 1A illustrates a front view of an articulating protective gear assembly configured in accordance with embodiments of the present technology.

FIG. 1A illustrates a front view of an articulating protective gear assembly 100 (such as a catcher's leg guard assembly), hereinafter referred to as a "leg guard" 100 for convenience, configured in accordance with embodiments of the present technology. In some embodiments, the leg guard 100 may include a shin guard portion 101 (for protecting a lower portion of a user's leg, which may include a lower portion of a user's knee) that articulates relative to a group 102 of knee guard portions (which includes a plurality of knee guard portions for protecting a user's knee), and a thigh guard portion 103 that articulates relative to the group 102 of knee guard portions (for protecting an upper portion of a user's leg). In some embodiments, the leg guard 100 may also include an ankle guard portion 104 that articulates relative to the shin guard portion 101 (for protecting an area near the user's ankle or the top or front of the user's foot).

In some embodiments, the leg guard 100 may include one or more retention elements 105 for securing the leg guard 100 to a user. The retention elements 105 may include conventional retention devices used in protective gear, such as one or more straps, buckles, D-rings, sleeves, loops, or other suitable devices, some of which are illustrated in the Figures for example only. In some embodiments, the shin guard portion 101 may include one or more first retention elements 105 (e.g., straps or elements for receiving straps for holding the shin guard portion 101 on a user's lower leg). In some embodiments, the group 102 of knee guard portions may include one or more second retention elements 105 (e.g., straps or elements for receiving straps for holding the group 102 of knee guard portions on a user's knee region). In some embodiments, the thigh guard portion 103 may include one or more third retention elements 105 (e.g., straps or elements for receiving straps for holding the thigh guard portion 103 on a user's thigh or upper leg).

The group 102 of knee guard portions may include one or more knee guard portions (which may overlap with one or more of each other) that articulate or move relative to each other, such as at least a first knee guard portion 107 and a second knee guard portion 110. The second knee guard portion 110 moves and articulates relative to the other parts of the group 102 of knee guard portions and relative to the thigh guard portion 103, such that the leg guard 100 can maintain protective coverage of the user's knee, shin, and thigh throughout the user's range of motion. The second knee guard portion 110 is referred to herein as a floating knee guard portion 110 because of its configuration to move relative to other parts of the leg guard 100 to maintain coverage of at least part of the user's anterior knee and thigh regions, as described in additional detail below. In some embodiments, the floating knee guard portion 110 may be omitted, such that only the first knee guard portion 107 is used.

In some embodiments, one or more (such as each) of the ankle guard portion 104, the shin guard portion 101, the group 102 of knee guard portions, or the thigh guard portion 103 may include one or more rigid protective shells supported on, or attached to, an underlying cushion material (e.g., padding). The rigid shells may deflect and spread impact forces, and the cushion material may absorb shocks and impact to protect the user. For example, the shin guard portion 101 may include a shin guard assembly 112 that includes a shin shell 114 attached to a shin pad 116. The first knee guard portion 107 may include a first knee guard assembly 118 that includes a first knee shell 120 attached to a first knee pad 122. The floating knee guard portion 110 may include a floating knee guard assembly 124 that includes a floating knee shell 126 attached to a floating knee pad 128. The thigh guard portion 103 may include a thigh guard assembly 130 that includes a thigh guard shell 132 attached to a thigh pad 134. The rigid shells 114, 120, 126, and 132 face away from the user on the anterior side of the leg guard 100. The pads 116, 122, 128, 134 may be positioned between the corresponding rigid shells and the user.

The pads 116, 122, 128, 134 may be attached to the corresponding shells with any suitable mode of attachment, such as fasteners, glue, tape, hook-and-loop devices, and the like. The shells 114, 120, 126, and 132 may be formed with any suitable material, including known materials used in protective gear that may allow a minimal amount of flexibility but generally retain their shape under normal use, such as plastic materials. The pads 116, 122, 128, 134 may be formed with any suitable material, including materials known for use in protective gear, such as foam, rubber, mesh, or other impact-absorbent or resilient materials suitable for cushioning between a player and the shell portions. In some embodiments, the pads may simply be a lining material.

Figure 1B:
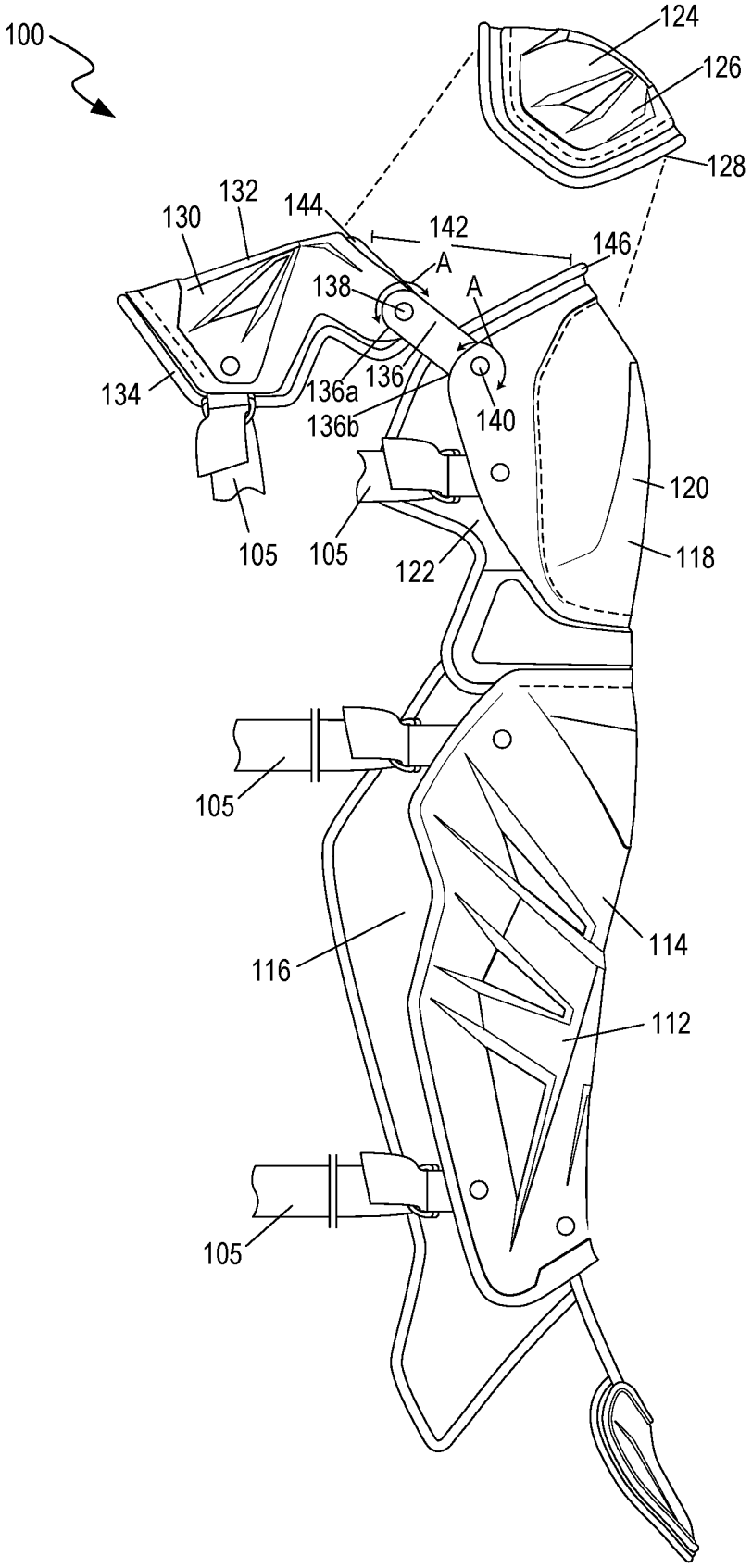
FIGS. 1B, 1C, and 1D illustrate partially schematic side perspective views of an articulating protective gear assembly in various states or configurations of motion, in accordance with embodiments of the present technology.
Figure 1C:
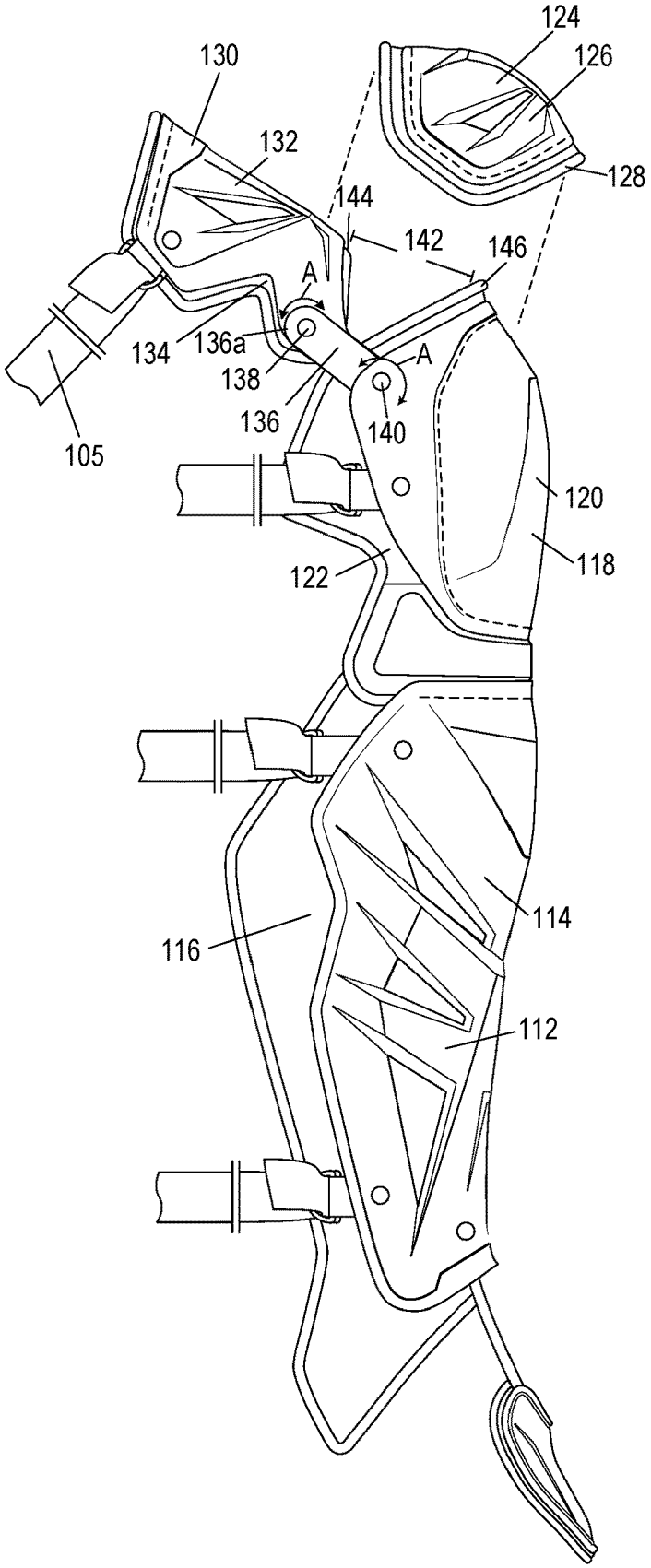
Figure 1D:
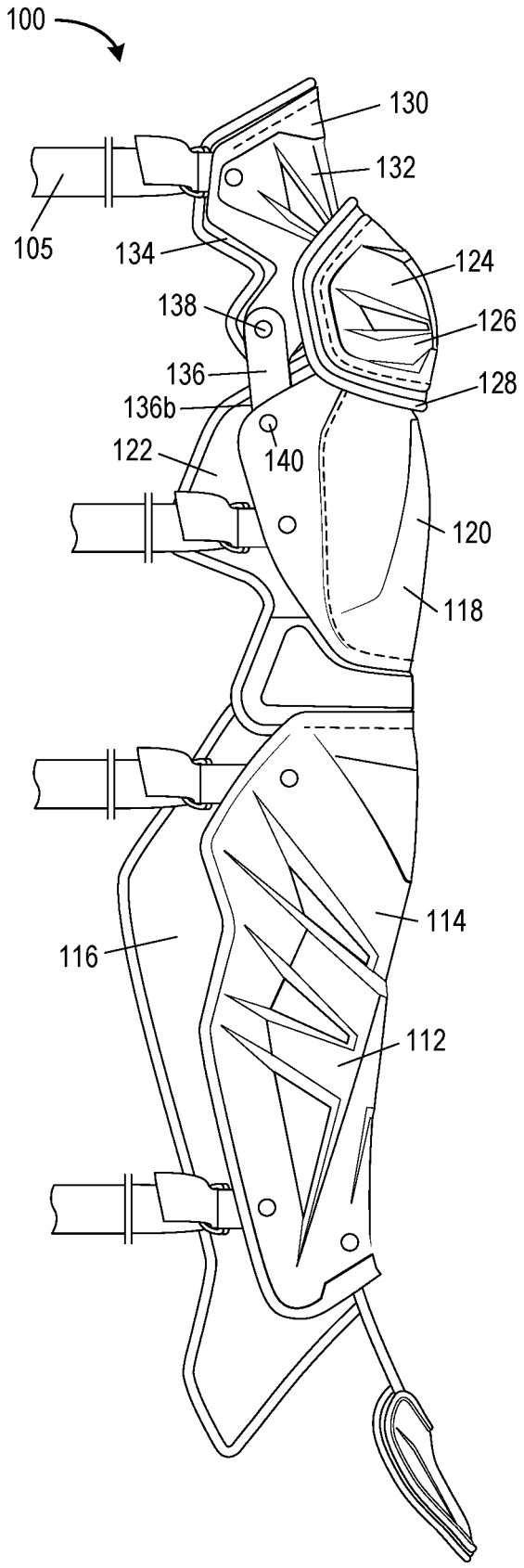

FIGS. 1B, 1C, and 1D illustrate partially schematic side-perspective views of the leg guard 100, in various states or configurations of motion of the knee. In some embodiments, the leg guard 100 includes connection elements 136 positioned on opposing lateral sides of the leg guard 100 to facilitate movement (e.g., rotation) between the first knee guard assembly 118 and the thigh guard assembly 130. Because FIGS. 1A, 1B, and 1C are side views, only a first connection element 136 is visible on a first lateral side of the leg guard 100; however, it is understood that a second connection element 136 is similarly positioned and connected on a second/opposing lateral side of the leg guard 100.

In some embodiments, a first end 136*a* of the first connection element 136 is rotatably attached to the thigh guard assembly 130 at a first upper pivot point 138 (defining at least a first upper rotation axis, such that the first connection element 136 may be rotatably attached to the thigh guard assembly 130 about the first upper rotation axis). A second end 136*b* of the first connection element 136 is rotatably attached to the first knee guard assembly 118 at a first lower pivot point 140 (which defines at least a first lower rotation axis that is spaced apart from the first upper rotation axis at the first upper pivot point 138, such that the first connection element 136 may be rotatably attached to the first knee guard assembly 118 about the first lower rotation axis). The second connection element 136 on the opposing lateral side of the leg guard 100, which is not visible, may be similarly connected to the guard assemblies 130, 118 at second upper and second lower pivot points (such that the second connection element 136 may be rotatably attached to the thigh guard assembly 130 about a second upper rotation axis, and rotatably attached to the first knee guard assembly 118 about a second lower rotation axis). As is visible and understood from at least FIGS. 1A, 1B, and 1C, each of the first upper rotation axis, the first lower rotation axis, the second upper rotation axis, and the second lower rotation axis is oriented along a direction extending transversely through (e.g., laterally through) the first lateral side of the leg guard and transversely through (e.g., laterally through) the second lateral side of the leg guard.

In operation, in some embodiments—and as seen in the sequence from FIG. 1B, to FIG. 1C, to FIG. 1D—the first knee guard assembly 118 is movable relative to the thigh guard assembly 130 between a first configuration in which the thigh guard assembly 130 is oriented generally transversely to the first knee guard assembly 118, and a second configuration different from the first configuration. For example, FIG. 1B shows a first configuration corresponding to a user's bent leg, FIG. 1D shows a second configuration corresponding to a user's straightened leg, and FIG. 1C shows an intermediate configuration between a bent leg and a straight leg. Arrows A in FIGS. 1B and 1C indicate rotation of the guard assemblies 118, 130 relative to the connection element 136 between the bent position and the straight position while the leg guard 100 articulates and moves with the user.

In some embodiments, when the user bends the leg guard 100, the knee guard assembly 118 and the thigh guard assembly 130 rotate to form a gap 142 therebetween. The gap 142 would expose a player's knee but for the floating knee guard assembly 124 that covers some or all of the gap 142. The gap 142 may be located between a lower anterior portion 144 of the thigh guard assembly 130 and an upper anterior portion 146 of the knee guard assembly 118. The gap 142 may have a maximum size (i.e., a maximum distance between the lower anterior portion 144 and the upper anterior portion 146) when the leg guard 100 is fully bent, and a minimum or negligible size when the leg guard 100 is fully straightened, or the gap 142 may close when the leg guard 100 is fully straightened.

The floating knee guard assembly 124 functions as an intermediate portion to cover at least part of the gap 142. The floating knee guard assembly 124 is positionable and configured to cover at least a portion of a user's anterior thigh or knee region, depending in part on how the user's leg and the leg guard 100 move relative to each other during use. It "floats" with the user's anterior thigh or knee region to maintain protection despite the gap 142 (i.e., it covers at least part of the gap 142). The floating knee guard assembly 124 may be attached to, but movable relative to, at least one (or both) of the thigh guard assembly 130 and the first knee guard assembly 118. The floating knee guard assembly 124 may be attachable to the first knee guard assembly 118 or the thigh guard assembly 130 by any suitable attachments, such as stitching, hook-and-loop fasteners, buttons, snaps, stretchable fabrics, resilient materials, and the like. An example attachment is described in additional detail below with regard to FIG. 3.

Figure 2:
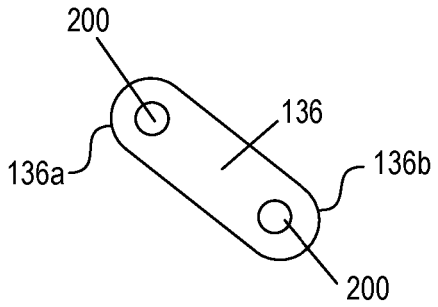
FIG. 2 illustrates a plan view of a connection element configured in accordance with embodiments of the present technology.

FIG. 2 illustrates a plan view of a connection element 136 configured in accordance with embodiments of the present technology. In some embodiments, a representative connection element 136 may include an elongated shape to accommodate the spaced-apart nature of the rotation axes of the connections with the first knee guard assembly 118 and the thigh guard assembly 130. In some embodiments, the connection elements 136 may have an obround shape, as illustrated in FIG. 2. Each connection element 136 may include attachment holes 200 for rotatably connecting the connection element 136 to the guard assemblies 118, 130 using fasteners, such as rivets, screws, or other suitable connectors, which may or may not pass through the connection elements 136 and the guard assemblies 118, 130. In other embodiments, the connection elements 136 may have other suitable shapes or features to form the double-hinge design of the present technology.

Figure 3:
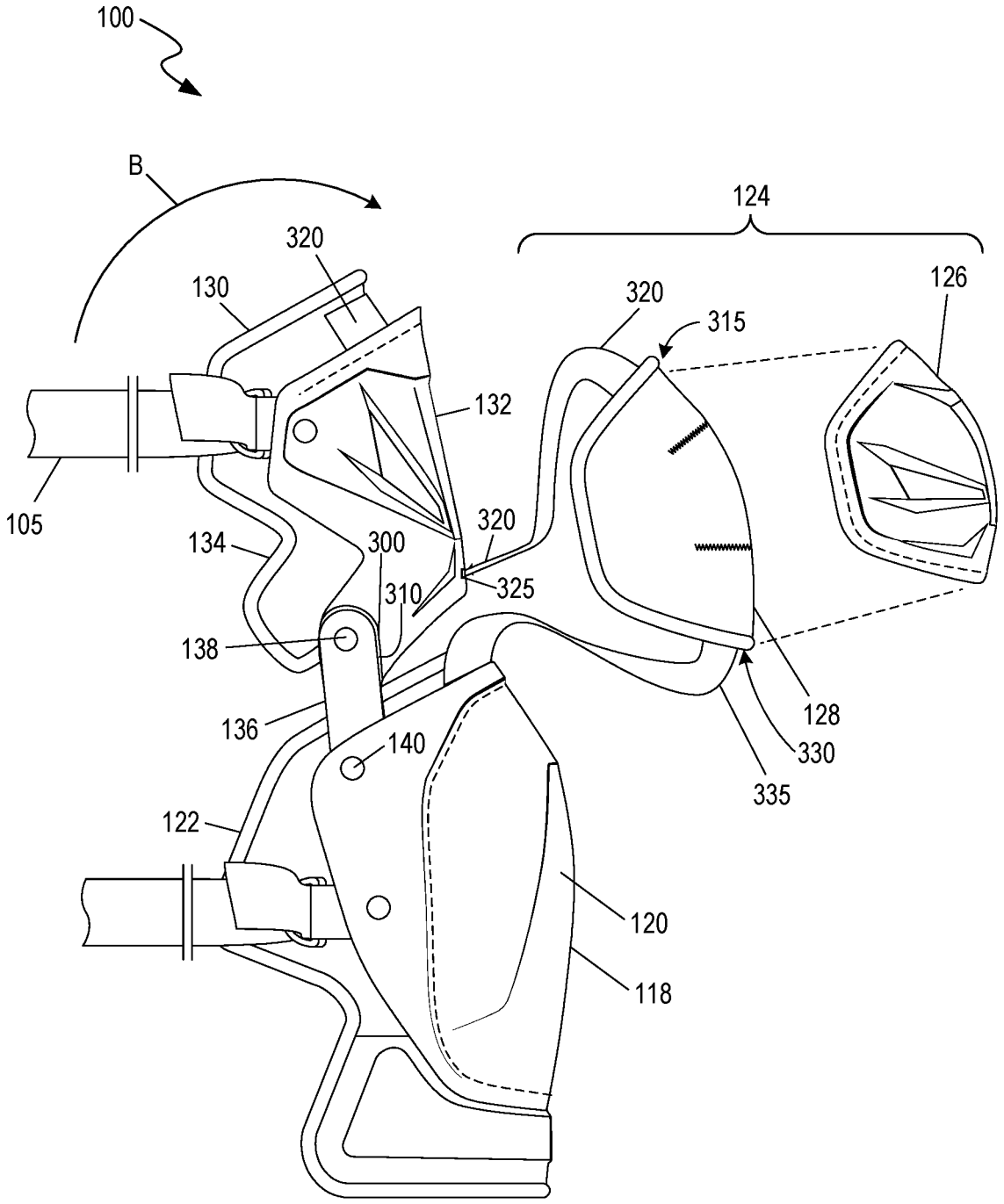
FIG. 3 illustrates a side, partially exploded view of a portion of the leg guard shown in FIGS. 1A-1D, in accordance with embodiments of the present technology.

FIG. 3 illustrates a side, partially exploded view of a portion of the leg guard 100, in accordance with embodiments of the present technology. In some embodiments, to resist or prevent overextension or hyperextension of a player's leg (or arm, if the guard is used for arms), a portion of the thigh guard assembly 130 may include a wall or another blocking element to limit rotation relative to the connection element 136. For example, in some embodiments, the thigh guard shell 132 may include an obstruction 300 at least partially positioned forward or anterior to the connection element 136 and at least partially below the first upper pivot point 138 (i.e., somewhere between the first upper pivot point 138 and the first lower pivot point 140). The obstruction 300 (which is described herein as a wall element 300) obstructs rotation of the thigh guard shell 132 relative to the connection element 136 along the direction indicated by arrow B, such that it may block the thigh guard shell 132 from rotating any further than engagement between the wall element 300 and the connection element 136 (e.g., as shown in FIG. 3).

Figure 3A:
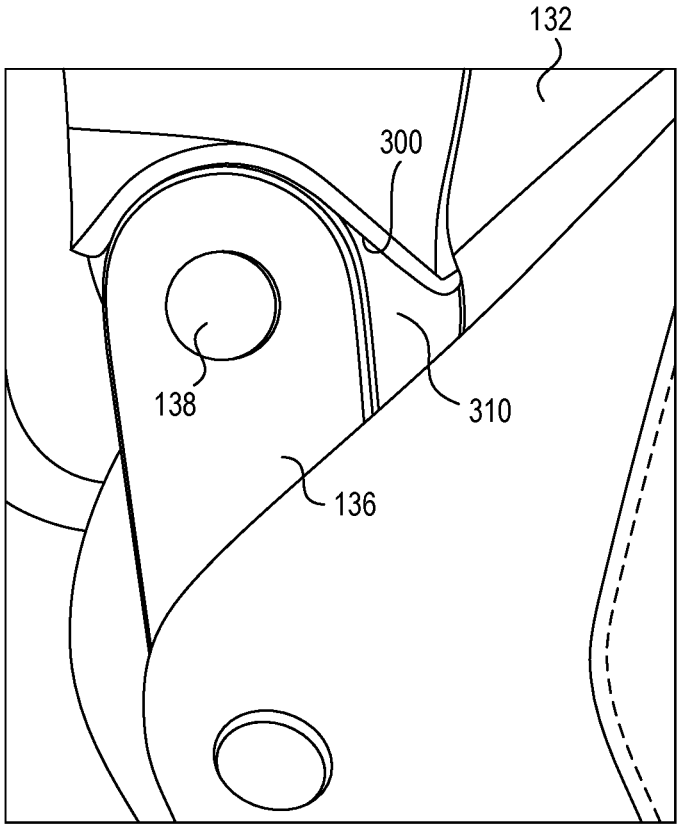
FIG. 3A illustrates a detailed view, from a side perspective, of a portion of the leg guard shown in FIGS. 1A-1D.

The wall element 300 at least resists, or prevents, the user's knee from straightening or over-extending beyond a safe limit (e.g., beyond closing the gap 142). In some embodiments, the wall element 300 may project from the remainder of the thigh guard shell 132. In other embodiments, as shown in FIG. 3 and in the detailed view illustrated in FIG. 3A, the wall element 300 defines at least part of an edge of a recess 310 in the thigh guard shell 132 that receives the connection element 136 such that the connection element 136 is sunk or recessed at least partially into the thigh guard shell 132. Although only one lateral side of the portion of the leg guard 100 is shown in FIGS. 3 and 3A, the other lateral side of the leg guard 100 may also include a wall element 300 (e.g., as an edge of a recess 310) to resist hyperextension.

FIG. 3 also illustrates a representative connection between the floating knee guard assembly 124 and other components of the leg guard 100. For example, in some embodiments, an upper portion 315 of the floating knee guard assembly 124 may be connected to the thigh guard assembly 130 via one or more first straps 320 (which may or may not have elastic properties). In some embodiments, the one or more first straps 320 may extend under a bottom edge of the thigh guard shell 132, or into a slot 325 formed in the thigh guard shell. The one or more first straps 320 may be suitably attached to the thigh guard shell 132 or the thigh pad 134.

A lower portion 330 of the floating knee guard assembly 124 may be connected to the first knee guard assembly 118 via one or more second straps 335 (which may or may not have elastic properties). The one or more second straps 335 may extend between the first knee shell 120 and the first knee pad 122, where it may be suitably attached to the first knee shell 120 or the first knee pad 122. The first and second straps 320, 335 enable the floating knee guard assembly 124 to translate relative to the other portions of the leg guard 100 and to otherwise articulate relative to the other portions of the leg guard 100, such that the floating knee guard assembly 124 "floats" to protect the user's knee (e.g., by covering the gap 142, see FIGS. 1B, 1C).

Figure 4A:
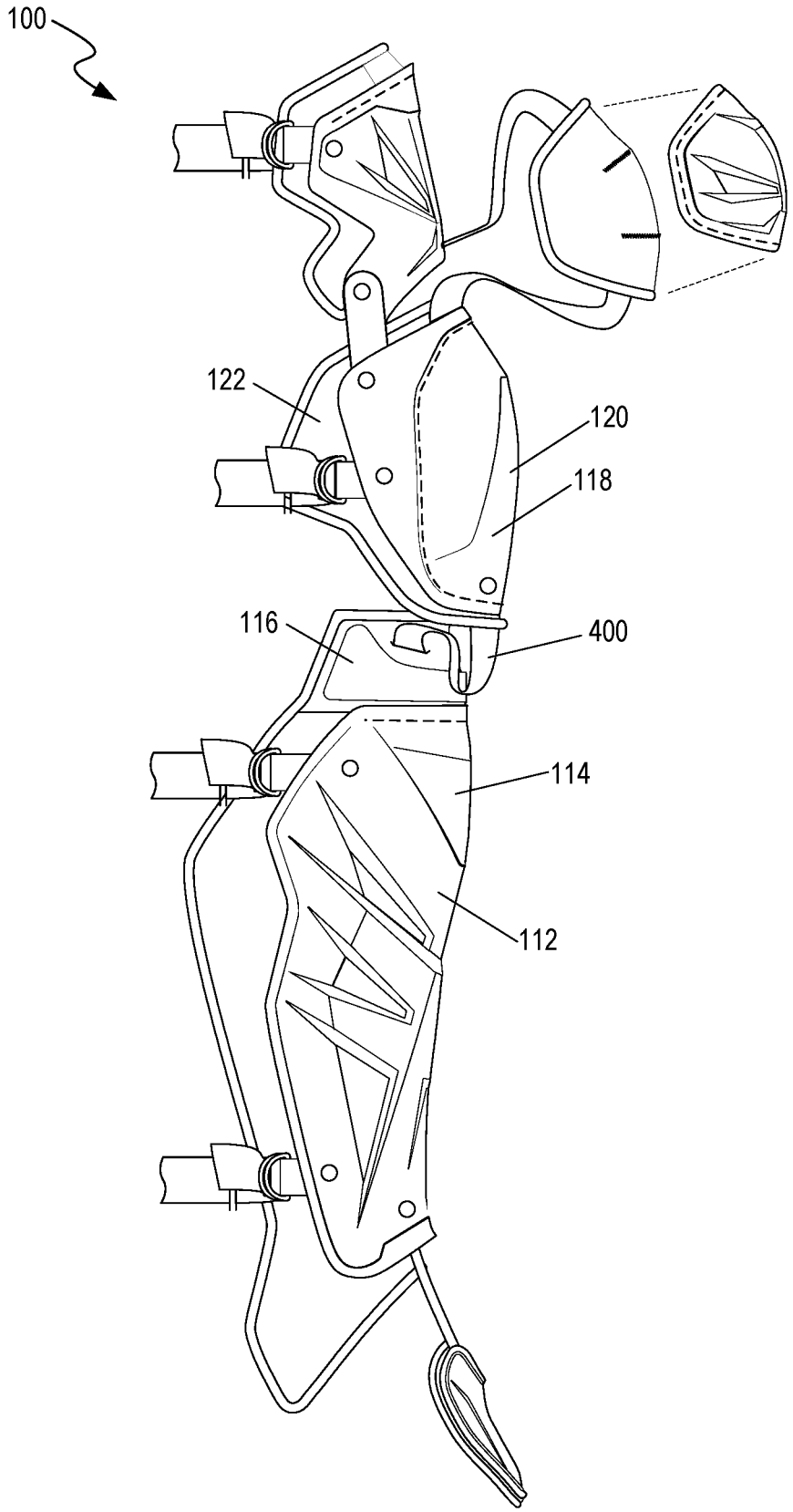
FIG. 4A illustrates a partially schematic, partially exploded side-perspective view of the leg guard shown in FIGS. 1A-1D.

FIG. 4A illustrates a partially schematic, partially exploded side-perspective view of the leg guard 100. While in some embodiments the first knee guard assembly 118 may be directly connected to the shin guard assembly 112 via an integral pad connection between their respective pads 122, 116, or by the knee shell 120 attached to the shin pad 116, in some embodiments, and as shown in FIG. 4A, the first knee guard assembly 118 may be connected to the shin guard assembly 112 via one or more straps 400 (which may be elastic or inelastic). The straps 400 further enhance articulation between the first knee guard assembly 118 and the shin guard assembly 112 by separating or decoupling them from each other except for the strap connection. The length of the one or more straps 400 relative to other components are exaggerated in FIG. 4A for purposes of illustration only. In some embodiments, the only connection(s) between the shin guard assembly 112 and the first knee guard assembly 118 may be the one or more straps 400.

Figure 4B:
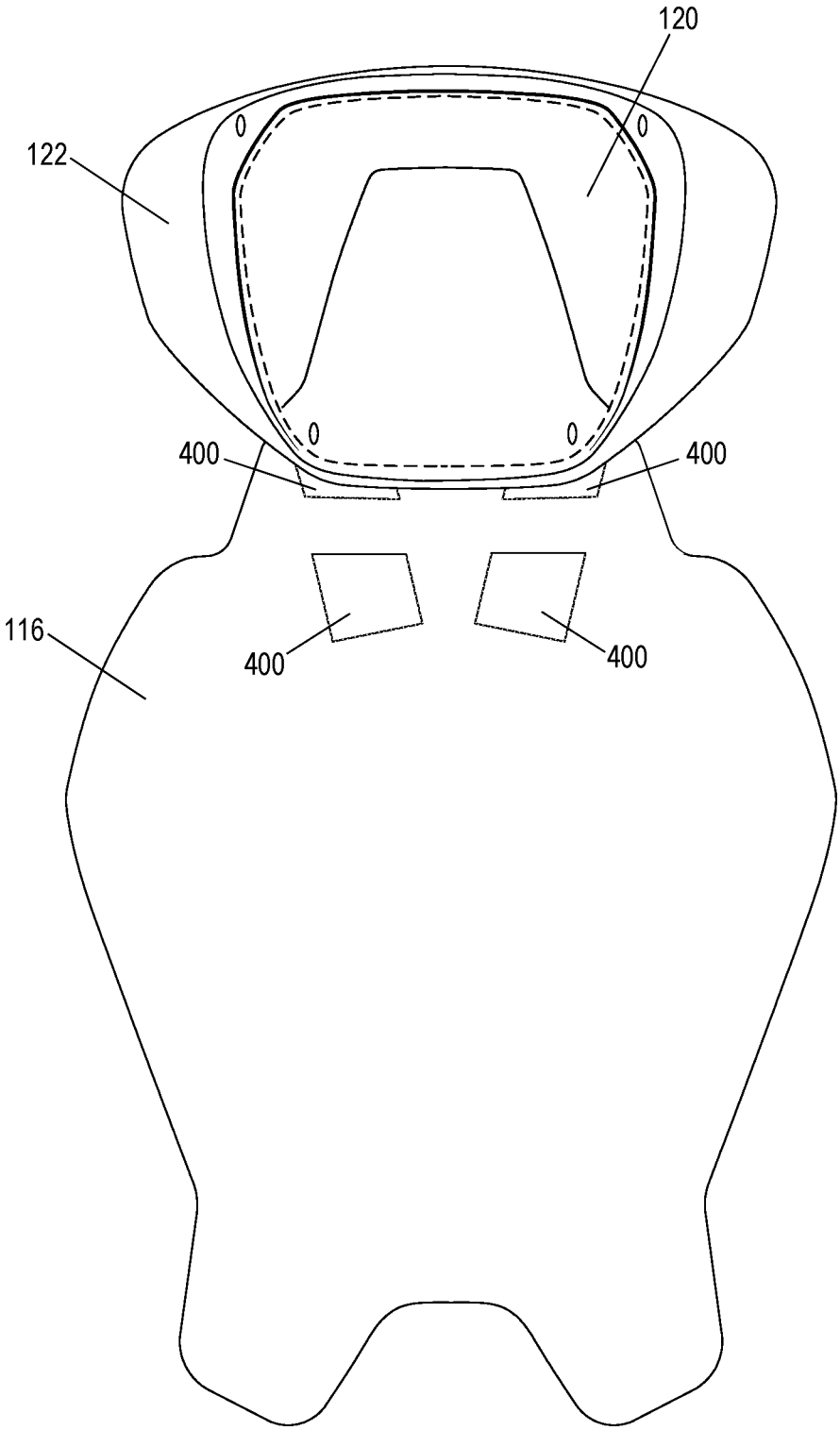
FIG. 4B illustrates a partially schematic front (anterior) view of portions of the leg guard shown in FIGS. 1A-1D.

FIG. 4B illustrates a partially schematic front (anterior) view of portions of the leg guard 100. In particular, FIG. 4B shows the first knee shell 120, the first knee pad 122, and the shin pad 116 (for illustration purposes, other components are omitted in this view, such as the shin shell). With reference to FIGS. 4A and 4B, in some embodiments, the one or more straps 400 may be attached to the first knee shell 120 (e.g., via one or more rivets, adhesive, stitching, or another suitable manner of attachment). The one or more straps 400 may be positioned between the first knee shell 120 and the first knee pad 122.

In some embodiments, the one or more straps may extend through the shin pad 116 (away from the anterior surface, toward a user), and then back out of the shin pad 116 (toward the anterior surface), where they may be attached to the shin pad 116 (e.g., via one or more rivets, adhesive, stitching, or another suitable manner of attachment). As seen in FIG. 4A, for example, the one or more straps 400 may be covered by the shin shell 114 in the assembled leg guard 100. This weaving of the one or more straps 400 in and out of the shin pad 116 facilitates highly articulable connection between the first knee guard assembly 118 and the shin guard assembly 112. Optionally, in some embodiments, a flexible cover material may be positioned between, and attached to the front of, each of one or more pairs of adjacent shells to further conceal the one or more straps.

Figure 4C:
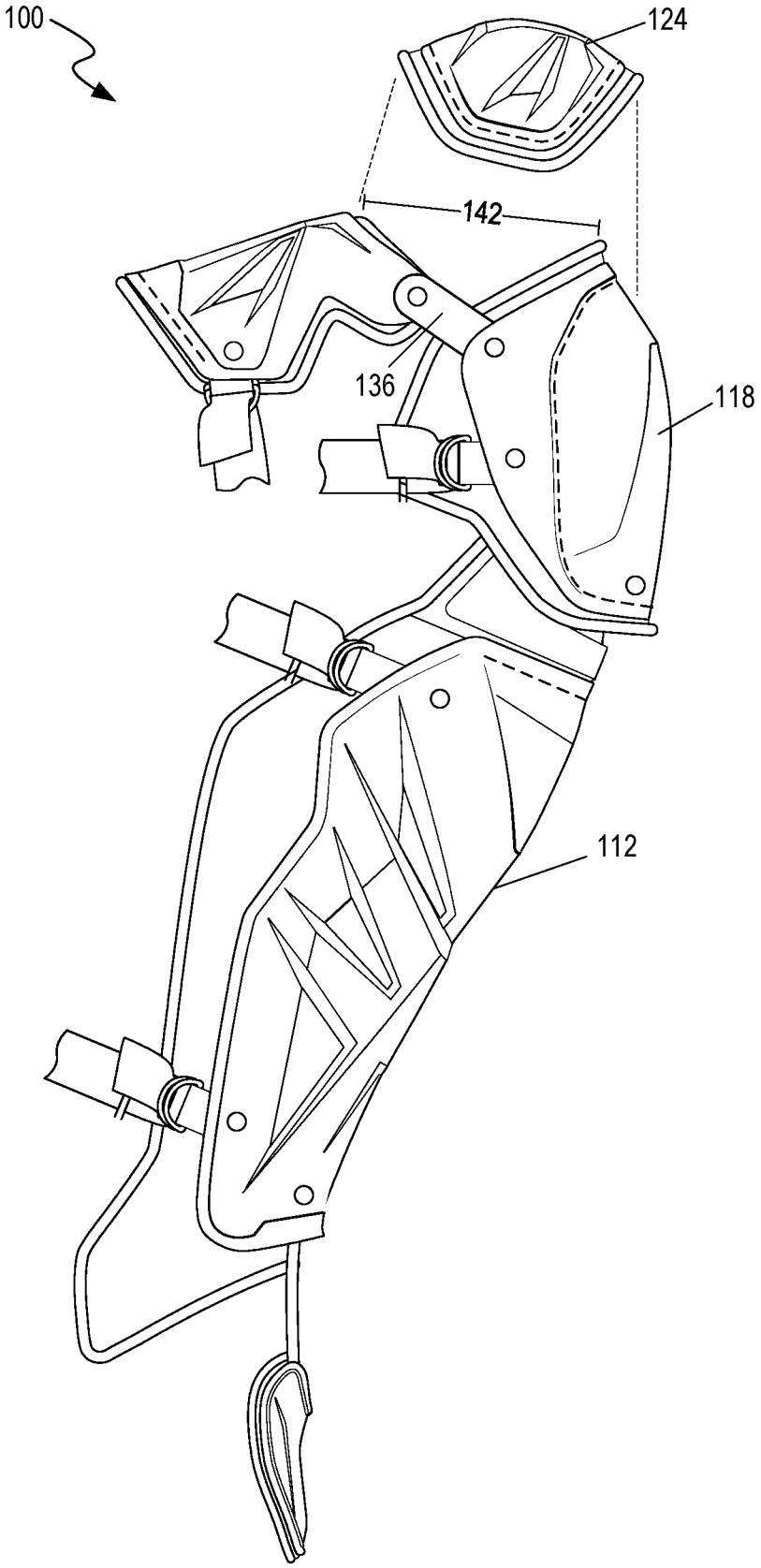
FIG. 4C illustrates a partially schematic, partially exploded side-perspective view of the leg guard shown in FIGS. 1A-1D, in which the leg guard 100 is bent in a manner that corresponds to a player in a crouched position.

FIG. 4C illustrates a partially schematic, partially exploded side-perspective view of the leg guard 100, in which the leg guard 100 is bent in a manner that corresponds to a player in a crouched position. As explained above with regard to FIGS. 1A-3, the floating knee guard assembly 124 may at least partially cover the gap 142, and as explained above with regard to FIGS. 4A and 4B, the one or more straps 400 (not visible in FIG. 4C at least because they may be concealed by other components of the leg guard 100) facilitate suitable flexure between the first knee guard assembly 118 and the shin guard assembly 112.

The shin guard portion 101, the group 102 of knee guard portions (including the floating knee guard portion 110), and the thigh guard portion 103 have been described above as including corresponding shells and pads. In some embodiments, however, the shells or the pads may be omitted, or in other embodiments, the shells and the pads may be formed integrally using suitable materials. Accordingly, in general, embodiments of the present technology include, for example, various thigh guard portions, groups of knee guard portions (including various floating knee guard portions) or a single knee guard portion, shin guard portions, and one or more connection elements 136, in which each connection element 136 has its own pivot point or pivot axis relative to the thigh guard portion and relative to a knee guard portion (e.g., the "first" knee guard portion 107). The relationship between the connection elements 136 and the portions they connect may be referred to as a "double hinge" because each side of the leg guard 100 has two pivot points in the knee region.

Returning to FIGS. 1B, 1C, and 1D, for example, in some embodiments, each connection element 136 may be positioned medially relative to the first knee shell 120 of the knee guard assembly 118 (i.e., inside the shell 120, closer to a player's leg than to the outside of the shell 120). In some embodiments, each connection element 136 may be positioned laterally relative to the thigh guard shell 132 of the thigh guard assembly 130 (i.e., outside the shell 132). Such an arrangement facilitates nesting of the components for simple operation. In some embodiments, the connection elements may be positioned in other locations, such as both inside the shell portions, both outside the shell portions, or the reverse of the embodiment shown in FIGS. 1B, 1C, and 1D.

Leg guards and other protective equipment configured in accordance with embodiments of the present technology may be formed with any suitable materials, such as generally rigid materials (such as plastic materials or injection-molded materials) for the shells 114, 120, 126, and 132, foam, rubber, mesh, fabric, or other materials suitable for the pads 116, 122, 128, 134, or other suitable materials for protecting a user's anatomy, absorbing or wicking sweat, absorbing impact energy, and so forth.

Guards and other protective equipment configured in accordance with embodiments of the present technology provide several advantages. For example, the connection elements 136, having two rotation axes relative to the knee and thigh components, provide improved range of mobility as a user's leg bends, relative to conventional protective gear designs. The multiple hinges (i.e., the double hinge) enable enhanced articulation relative to more constrained designs with only one pivot axis.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, although leg guards are described, embodiments of the present technology may be implemented in other protective equipment, such as arm guards. For example, instead of shin, thigh, and knee elements, an arm guard may include forearm, upper arm, and elbow elements. Accordingly, protective gear of the present technology may be implemented in other devices and equipment. Although the connection elements 136 are described as being connected to shells, in some embodiments, they may be connected to, and pivotable relative to, the pads.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A leg guard comprising:

a knee guard assembly positionable to cover at least a portion of a user's anterior knee region;

a thigh guard assembly positionable to cover at least a portion of a user's anterior thigh region;

a first connection element positioned on a first lateral side of the leg guard, wherein the first connection element is rotatably attached to the thigh guard assembly about a first upper rotation axis, and wherein the first connection element is rotatably attached to the knee guard assembly about a first lower rotation axis; and a second connection element positioned on a second lateral side of the leg guard opposite the first lateral side, wherein the second connection element is rotatably attached to the thigh guard assembly about a second upper rotation axis, and wherein the second connection element is rotatably attached to the knee guard assembly about a second lower rotation axis; wherein:

the knee guard assembly is movable relative to the thigh guard assembly between a first configuration in which the thigh guard assembly is oriented transversely to the knee guard assembly, and a second configuration that is different than the first configuration; and each of the first upper rotation axis, the first lower rotation axis, the second upper rotation axis, and the second lower rotation axis is oriented along a direction extending through the first lateral side of the leg guard and through the second lateral side of the leg guard.

2. The leg guard of claim 1, wherein the knee guard assembly is a first knee guard assembly, the leg guard further comprising a floating knee guard assembly positionable to cover at least a portion of a user's anterior knee or thigh region, wherein the floating knee guard assembly is attached to, and movable relative to, at least one of the thigh guard assembly or the first knee guard assembly, and wherein the floating knee guard assembly covers at least part of a gap between the thigh guard assembly and the first knee guard assembly when the leg guard is in the first configuration.

3. The leg guard of claim 2, wherein the floating knee guard assembly comprises a rigid shell portion and a pad portion.

4. The leg guard of claim 2, wherein the floating knee guard assembly is attached to the thigh guard assembly via one or more first straps, and wherein the floating knee guard assembly is attached to the first knee guard assembly via at least one second strap.

5. The leg guard of claim 4, wherein the one or more first straps are elastic straps.

6. The leg guard of claim 1, wherein the knee guard assembly comprises a rigid shell portion and a pad portion.

7. The leg guard of claim 1, further comprising a shin guard portion positionable to protect at least part of a user's lower leg.

8. The leg guard of claim 7, wherein the shin guard portion includes:

a shin shell;

a shin pad attached to the shin shell; and one or more retention elements positionable to secure the shin guard portion on a user.

9. The leg guard of claim 8, wherein the knee guard assembly comprises a knee shell, and wherein the leg guard further comprises one or more straps connecting the knee shell to the shin shell.

10. The leg guard of claim 9, wherein the one or more straps define the only connection between the knee guard portion assembly and the shin guard portion.

11. The leg guard of claim 1, wherein the thigh guard assembly comprises:

a thigh shell;

a thigh pad attached to the thigh shell; and one or more retention elements positionable to secure the thigh guard assembly on a user.

12. The leg guard of claim 1, wherein each of the first connection element and the second connection element comprises an obround shape.

13. The leg guard of claim 1, wherein each of the first connection element and the second connection element is connected to the knee guard assembly via a fastener passing through the first connection element and at least part of the knee guard assembly, and wherein each of the first connection element and the second connection element is connected to the thigh guard assembly via another fastener passing through the connection elements and at least part of the thigh guard assembly.

14. The leg guard of claim 1, wherein:

the knee guard assembly comprises a rigid knee shell;

the thigh guard assembly comprises a rigid thigh shell; and for each of the first connection element and the second connection element, the connection element is positioned medially relative to the knee shell and laterally relative to the thigh shell.

15. The leg guard of claim 1, wherein:

the thigh guard assembly comprises a wall element positioned to engage at least one of the connection elements when the leg guard is in the second configuration, to resist extension of the leg guard beyond the second configuration.

16. The leg guard of claim 15, wherein the thigh guard assembly comprises a rigid thigh shell, the wall element defines at least part of an edge of a recess in the thigh shell, and the recess receives the first connection element, wherein the first connection element is recessed at least partially into the thigh shell.

17. An articulating protective gear assembly comprising:

a first guard assembly including at least at least part of a first device for securing the articulating protective gear assembly on a user;

a second guard assembly including at least part of a second device for securing the articulating protective gear assembly on a user;

two connection elements connecting the first guard assembly to the second guard assembly, wherein a first connection element of the two connection elements is positioned at a first lateral side of the articulating protective gear assembly, and a second connection element of the two connection elements is positioned at a second lateral side of the articulating protective gear assembly opposite the first lateral side; and an intermediate portion; wherein:

a first end of one of the connection elements is rotatably connected to the first guard assembly about an axis oriented along a direction extending laterally through the first lateral side and the second lateral side;

a second end of the one of the connection elements is positioned opposite the first end and rotatably connected to the second guard assembly; and the intermediate portion is positioned to cover at least part of a gap between the first guard assembly and the second guard assembly when the first guard assembly is moved relative to the second guard assembly via the two connection elements.

18. The articulating protective gear assembly of claim 17, wherein at least the one of the connection elements comprises an obround shape.

19. The articulating protective gear assembly of claim 17, wherein the intermediate portion comprises a third rigid shell portion.

20. The articulating protective gear assembly of claim 17, wherein the at least at least part of a first device for securing the articulating protective gear assembly on a user comprises one or more straps, one or more sleeves, one or more buckles, or one or more loops.

21. A leg guard for a baseball or softball catcher, the leg guard comprising:

a shin guard assembly positionable to protect a lower portion of a user's leg;

a thigh guard assembly positionable to protect an upper portion of a user's leg;

a knee guard assembly positionable to protect at least part of a user's knee; and two connection elements connecting the knee guard assembly to the thigh guard assembly, wherein at least one of the connection elements is rotatably attached to the knee guard assembly about a first rotation axis and rotatably attached to the thigh guard assembly about a second rotation axis that is spaced apart from the first rotation axis, and wherein the first rotation axis is oriented along a direction that extends transversely through opposing lateral sides of the leg guard.

22. The leg guard of claim 21, wherein the knee guard assembly is a first knee guard assembly, the leg guard further comprising a floating knee guard assembly positionable to at least partially cover a gap between the first knee guard assembly and the thigh guard assembly when the leg guard is in a bent configuration.

23. The leg guard of claim 21, wherein the thigh guard assembly comprises an obstruction limiting rotation of the knee guard assembly relative to the thigh guard assembly.

* * * * *